US011235845B2

(12) United States Patent
Jackson

(10) Patent No.: US 11,235,845 B2
(45) Date of Patent: Feb. 1, 2022

(54) WATERCRAFT FLOAT FOR USER PROPELLED WATERCRAFT

(71) Applicant: Jeffery Jackson, Chapin, SC (US)

(72) Inventor: Jeffery Jackson, Chapin, SC (US)

( * ) Notice: Subject to any disclaimer, the term of this patent is extended or adjusted under 35 U.S.C. 154(b) by 0 days.

(21) Appl. No.: 15/825,552

(22) Filed: Nov. 29, 2017

(65) Prior Publication Data

US 2020/0298947 A1 Sep. 24, 2020

(51) Int. Cl.
*B63C 1/04* (2006.01)

(52) U.S. Cl.
CPC ..... *B63C 1/04* (2013.01)

(58) Field of Classification Search
CPC .... B63C 1/02; B63C 1/04; B63C 1/12; B63C 3/02; B63C 3/08; B63C 3/12
USPC ..... 114/258, 259, 263, 264, 266, 267, 365, 114/366, 375, 376
See application file for complete search history.

(56) References Cited

U.S. PATENT DOCUMENTS

| | | | | |
|---|---|---|---|---|
| 3,734,046 | A | 5/1973 | Schmidt | |
| 5,249,545 | A | 10/1993 | Gettman | |
| 5,489,228 | A | 2/1996 | Richardson | |
| D401,547 | S | 11/1998 | Karliner | |
| 5,855,180 | A | 1/1999 | Masters | |
| 5,875,727 | A | 3/1999 | Elson | |
| 5,941,660 | A * | 8/1999 | Rueckert | B63C 1/02 114/263 |
| 6,006,687 | A | 12/1999 | Hillman | |
| 6,431,106 | B1 | 8/2002 | Eva | |
| D506,431 | S | 6/2005 | Elson | |
| D521,442 | S | 5/2006 | Ostreng | |
| 7,051,668 | B1 | 5/2006 | Quinto | |
| 7,063,033 | B1 | 6/2006 | Jackson | |
| 7,069,872 | B2 | 7/2006 | Ostreng | |
| 7,117,809 | B2 | 10/2006 | Lamoureux | |
| D532,360 | S | 11/2006 | Ostreng | |
| 7,213,531 | B2 | 5/2007 | Ahern | |
| 7,293,522 | B1 | 11/2007 | Elson | |
| D558,659 | S | 1/2008 | Jackson | |

(Continued)

FOREIGN PATENT DOCUMENTS

GB GB 2075923 A 11/1981

OTHER PUBLICATIONS https://www.cellofoam.com/Permafloat.htm; and "PERMALAUNCH Brochure 2016" available on the Internet at least as early as Mar. 27, 2017 see wayback machine capture included (Year: 2016).*

(Continued)

*Primary Examiner* — Anthony D Wiest
(74) *Attorney, Agent, or Firm* — The Law Offices of Eric W. Peterson

(57) ABSTRACT

A watercraft float having a deck surface and bottom surface, a watercraft receiving area, a first post having a base, side, and top surface, wherein the first post is positioned on a first side of the watercraft receiving area, a second post having a base, side, and top surface, wherein the second post is positioned on a second side of the watercraft receiving area, and a railing, wherein the railing releaseably engages the two posts, wherein the base of the first post and the base of the second past are engaged to the deck surface, wherein each post is configured so that a user can propel a watercraft onto the float utilizing the post, and wherein the watercraft receiving area is configured to receive a watercraft.

12 Claims, 11 Drawing Sheets

(56) References Cited

U.S. PATENT DOCUMENTS

| | | | | |
|---|---|---|---|---|
| D559,165 | S | 1/2008 | Jackson | |
| 7,552,495 | B1 | 6/2009 | Rogerson | |
| D598,576 | S | 8/2009 | Henriquez | |
| 8,256,366 | B2 * | 9/2012 | Imel | B63C 3/06 114/263 |
| 8,904,950 | B2 | 12/2014 | Jackson | |
| 9,051,035 | B2 * | 6/2015 | Imel | B63B 27/00 |
| 10,315,738 | B2 * | 6/2019 | Imel | B63C 1/02 |
| 2005/0172876 | A1 * | 8/2005 | Ostreng | B63C 1/02 114/45 |
| 2007/0169678 | A1 * | 7/2007 | Dickman | B63C 1/02 114/263 |
| 2008/0264321 | A1 | 10/2008 | Jackson | |
| 2008/0282958 | A1 | 11/2008 | Jackson | |
| 2012/0048154 | A1 * | 3/2012 | Toomer | B65D 19/0018 108/53.3 |

OTHER PUBLICATIONS https://www.kayakdock.com/; retrieved from the internet on Sep. 1, 2020, available at least as early as & Jan. 2017, .see wayback machine capture included (Year: 2017).*

* cited by examiner

WATERCRAFT FLOAT FOR USER PROPELLED WATERCRAFT

BACKGROUND

Watercraft floats that allow for a watercraft to dock are well known. The watercraft is propelled onto a watercraft float within a watercraft receiving area to receive the hull of the watercraft. Watercraft floats lift the watercraft out of the water thereby reducing damage to the watercraft caused by the watercraft from being stored in the water, allowing for the watercraft to be more easily serviced, and allowing for the watercraft to be easily boarded and disembarked by the user. Watercraft floats are fitted for large watercraft and are not versatile allowing them to be used for smaller sized watercrafts that utilize user-propelling means, such as paddling.

SUMMARY OF THE INVENTION

The present disclosure pertains to a watercraft float having a deck surface and bottom surface, a watercraft receiving area, a first post having a base, side, and top surface, wherein the first post is positioned on a first side of the watercraft receiving area, and a second post having a base, side, and top surface, wherein the second post is positioned on a second side of the watercraft receiving area, wherein the base of the first post and the base of the second past are engaged to the deck surface, wherein each post is configured so that a user can propel a watercraft onto the float utilizing the post, and wherein the watercraft receiving area is configured to receive a watercraft.

One aspect of the disclosure is a float having a receiving area rim, wherein the post engages the receiving area rim. Another aspect of the disclosure is a float having a third post and a fourth post, wherein the first post and third post are positioned in a line on a first side of the watercraft receiving area, and wherein the second post and fourth post are positioned in a line on a second side of the watercraft receiving area. Another aspect of the disclosure is a float wherein the watercraft is a self-propelled watercraft.

Another aspect of the disclosure is a float having a railing, wherein the railing releaseably engages at least two posts. Another aspect of the disclosure is a float wherein the at least two posts as positioned on a first side of the watercraft receiving area. Another aspect of the disclosure is a float wherein the railing is used to propel the watercraft onto or off or the watercraft float by the user gripping the railing.

Another aspect of the disclosure is a float having a first railing and a second railing, wherein the first railing releaseably engages at least the first post and the third post, and wherein the second railing releaseably engages at least the second post and the fourth post. Another aspect of the disclosure is a float wherein the engagement of the railing with the at least two posts defines a propelling notch configured to receive a propelling device. Another aspect of the disclosure is a float wherein upon the propelling notch receiving the propelling device, the engagement of the railing with the at least two posts is configured to prevent the propelling device from sliding down the side of the posts or sliding over the top surface of the posts. Another aspect of the disclosure is a float wherein the post has a hole configured to receive the railing. Another aspect of the disclosure is a float wherein the hole passes through the width of the post.

Another aspect of the disclosure is a float having a securing mechanism configured to releaseably secure the railing to the posts. Another aspect of the disclosure is a float wherein the securing mechanism has a railing hole configured within the railing, a post hole configured within the post, and a securing rod, wherein upon the hole in the post receiving the railing, the railing hole and post hole are aligned so that both the railing hole and post hole receive the securing rod.

Another aspect of the disclosure is a float wherein a first watercraft float is configured to be stacked with a second watercraft float. Another aspect of the disclosure is a float wherein the releaseability of the railing allows for the first watercraft float to be stacked with the second watercraft float. Another aspect of the disclosure is a float having a post cavity located at a position within the bottom surface of the first watercraft float so that the post cavity is configured to receive a post of the second watercraft float upon the two watercraft floats positioned in a stacked array. Another aspect of the disclosure is a float having a mooring system for securing the watercraft float to a dock. Another aspect of the disclosure is a float wherein the watercraft float further has a mooring hole and the mooring system has a mooring post and mooring mechanism, wherein the mooring hole is configured to receive the mooring post, and wherein the mooring mechanism is configured to secure the mooring post to the dock.

With those and other objects, advantages and features on the invention that may become hereinafter apparent, the nature of the invention may be more clearly understood by reference to the following detailed description of the invention, the appended claims, and the drawings attached hereto.

BRIEF DESCRIPTION OF THE DRAWINGS

The accompanying drawings, which are incorporated herein and form part of the specification, illustrate various embodiments of the present invention and together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION

In the following detailed description, reference is made to the accompanying drawings which form a part hereof and in which is shown by way of illustration specific embodiments in which the invention may be practiced. These embodiments are described in sufficient detail to enable those skilled in the art to practice the invention, and it is to be understood that other embodiments may be utilized and that structural or logical changes may be made without departing from the scope of the present invention. The following detailed description is, therefore, not to be taken in a limiting sense, and the scope of the present invention is defined by the appended claims.

Figure 1:
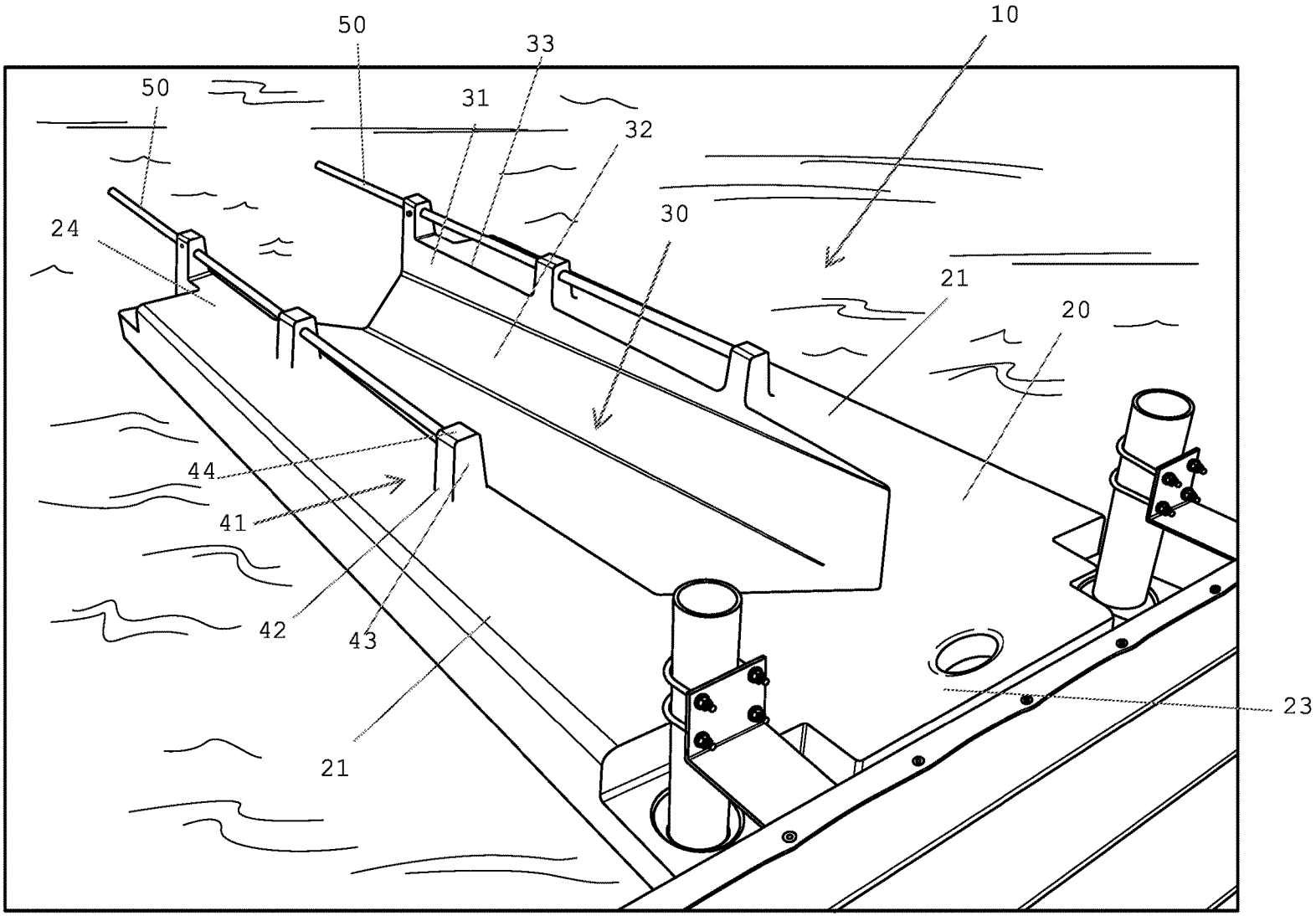
FIG. 1 is a perspective view of a watercraft float according to an exemplary embodiment.
Figure 2:
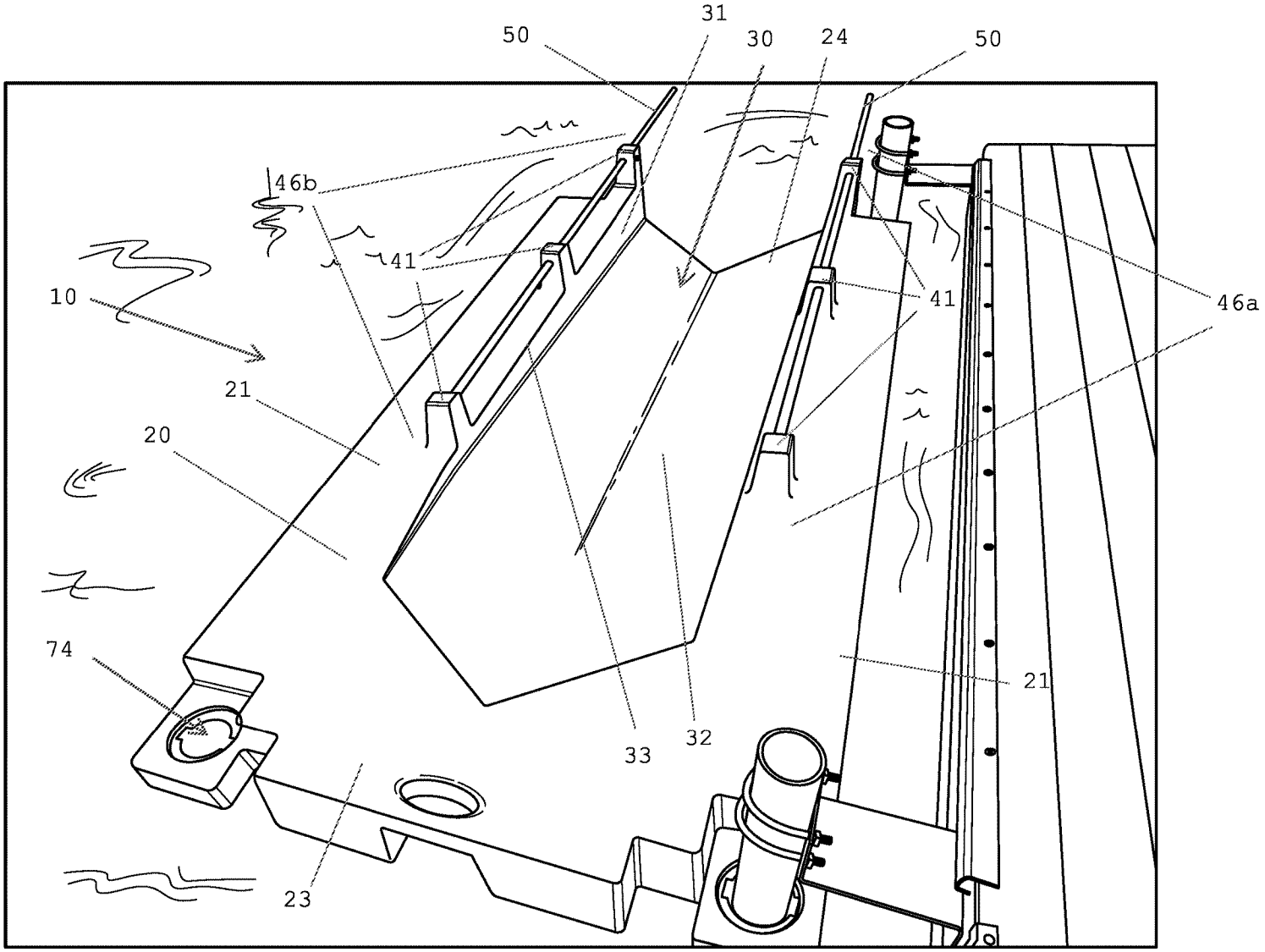
FIG. 2 is a perspective view of a watercraft float according to an exemplary embodiment.

The present disclosure pertains to a watercraft float 10 for receiving a watercraft 80. The watercraft float 10 has a hollow hull for enabling the watercraft float 10 to float on water. The watercraft float 10 can be a drive-on watercraft 80 float. As shown in FIG. 1, the watercraft float 10 can have a deck surface 20, sides 21, a bottom surface 22, front 23, rear 24, and a watercraft receiving area 30. The watercraft receiving area 30 is defined by the receiving area walls 31 and a receiving surface 32, where the receiving area walls 31 engage the deck surface 20 thereby defining a receiving area rim 33. The watercraft receiving area 30 can be a cavity within the deck surface 20. The receiving surface 32 can be angled where the distance between the receiving surface 32 and the receiving area rim 33 at a location closer to the rear 24 is greater than the distance between the receiving surface 32 and the receiving area rim 33 further from the rear 24. The deck surface 20 allows for a user to walk on a surface of the watercraft float 10. The watercraft receiving area 30 is substantially centered between sides 21. The surface receiving surface 32 of the watercraft receiving area 30 can have any shape that allows the watercraft float 10 to receive a watercraft 80, for example, concave, angled recess, multi-tiered angled recess, or the like. The watercraft receiving area 30 opens at the rear 24 of the watercraft float 10 to receive a watercraft 80. The watercraft float 10 can be sized to receive various sized watercrafts 80, for example, without limitation, small watercrafts that are user propelled, such as a kayak, canoe, small boat, or the like, small watercrafts that are propelled by a small motor, such as a dingy, or the like, or sized to receive large watercrafts, such as a speedboat, sailboat, or the like. The watercraft 80 can have a propelling device 82, such as a paddle, oar, or the like. The propelling device 82 can have a rod 84.

In one embodiment, the watercraft float 10 has a propelling system 40 configured to allow a user to propel the watercraft 80 onto the watercraft float 10. The propelling system 40 can be configured to be utilized by the user while the user is positioned within the watercraft 80, for example, without limitation, while the user is seated or standing within the watercraft 80.

In one embodiment, the propelling system 40 has at least one post 41. The post 41 can have a base 42, side portions 43, and a top surface 44. The post 41 can engage the watercraft float 10 at any location and orientation that allows for the post 41 to protrude vertically from the watercraft float 10. In one embodiment, the post 41 is positioned along the receiving area rim 33 of the watercraft receiving area 30. In one embodiment, the base 42 of the post 41 engages the deck surface 20 of the watercraft float 10 at the base of the post 41. In one embodiment, the post 41 is molded into the watercraft float 10. In one embodiment, where the watercraft float 10 has multiple posts 41, the posts 41 can engage the watercraft float 10 on a same horizontal plane of the watercraft float 10, thereby resulting in the top surface 44 of the posts 41 being substantially positioned within the same horizontal plane. The number of posts 41 can be dependent on the length of the watercraft float 10, the length of the watercraft 80, the angle of the receiving surface 32 with a horizontal plane of the watercraft float 10, or the like. In one embodiment, the watercraft float 10 can have at least one line of posts 46 where the posts 41 or a portion of the number of posts 41 are positioned substantially in a line. The line of posts 46 can be positioned along the receiving area rim 33 of the watercraft receiving area 30. In one embodiment, where the watercraft float 10 has two lines of posts 46, a first line of posts 46*a* is positioned on one side of the receiving area rim 33 and a second line of posts 46*b* is positioned on another side of the receiving area rim 33. In one embodiment, where the watercraft float 10 has two lines of posts 46, one post 41 of a first line of posts 46*a* is positioned within the substantially same cross-sectional plane as at least one post 41 of a second line of posts 46*b*.

The post 41 allows for a user to propel the watercraft 80 onto the watercraft float 10, onto the receiving surface 32, into the watercraft receiving area 30, off of the watercraft float 10, off of the receiving surface 32, out of the watercraft receiving area 30, and/or the like. For example, without limitation, where the user desires to propel the watercraft 80 onto the receiving surface 32, the user can position a propelling device 82 or portion thereof, for example, the rod 84 of the propelling device 82 on a side portion 43 of a first post 41*a* from a first line of posts 46*a* and side portion 43 of a second post 41*b* from a second line of posts 46*b*, and exert a pulling force onto the posts 41*a,b* thereby propelling the watercraft 80 from the water toward the front 23 of the watercraft float 10 and/or onto the receiving surface 32 of the watercraft float 10. In the same manner, the user can exert a pulling force on subsequent posts 41 until the watercraft 80 is propelled to the desired location on the receiving surface 32.

By way of another example, without limitation, where the user desires to propel the watercraft 80 off of the receiving surface 32, the user can position a propelling device 82 or portion thereof, for example, the rod 84 of the propelling device 82 on a side portion 43 of a first post 41*a* from a first line of posts 46*a* and side portion 43 of a second post 41*b* from a second line of posts 46*b* and exert a pushing force onto the post 41*a,b* thereby propelling the watercraft 80 from the receiving surface 32 of the watercraft float 10 toward the rear 24. In the same manner, the user can exert a pushing force on subsequent posts 41 until the watercraft 80 is propelled onto the water.

In one embodiment, the propelling system 40 has at least one railing 50. The railing 50 can engage or releaseably engage a plurality of posts 41 within a line of posts 46. For example, without limitation, the railing 50 can releaseably engage a first post 41*a* and a second post 41*c*. By way of another example, a first railing 50*a* can releaseably engage a first post 41*a*, a second post 41*c*, and a third post 41*e*, and a second railing 50*b* can releaseably engage a first post 41*b*, a second post 41*d*, and a third post 41*f*.

Figure 5:
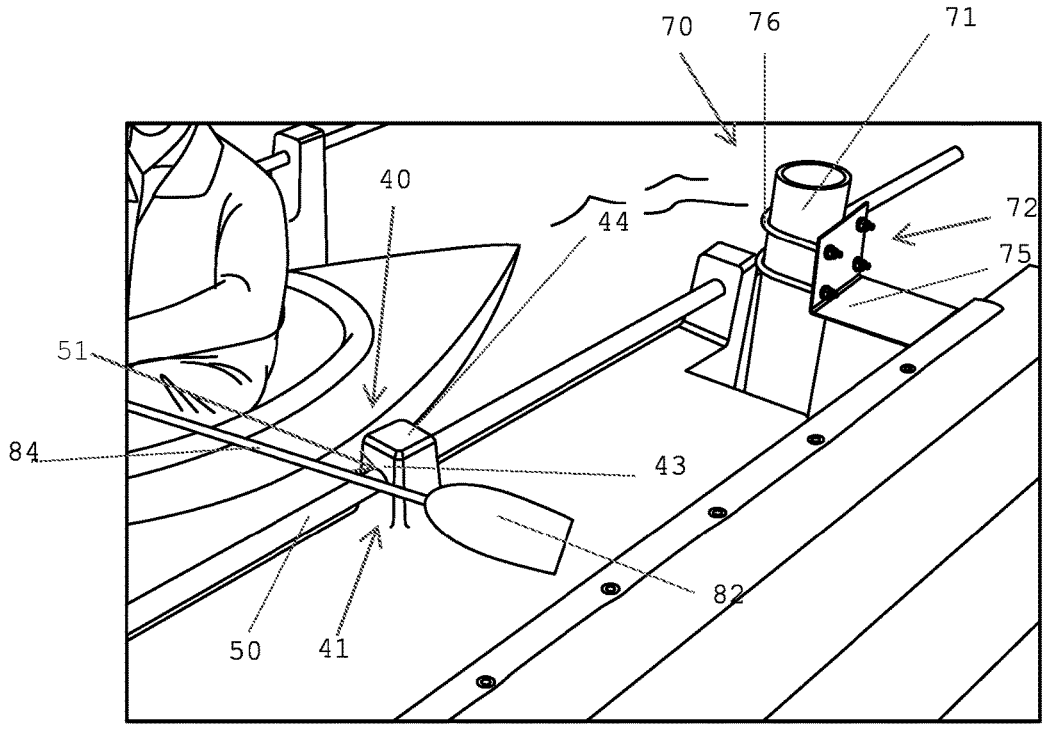
FIG. 5 is a perspective view of a portion of watercraft float according to an exemplary embodiment.

In one embodiment, as shown in FIG. 5, the railing 50 can be positioned at a location on a post 41 where the post 41 prevents the propelling device 82 from sliding over the top surface 44 of the post 41. Specifically, the engagement of the railing 50 and the post 41 defines a propelling notch 51 that is configured to receive the propelling device 82 in a manner that prevents the propelling device 82 from sliding down the side 43 of the post 41 or sliding over the top surface 44 of the post 41. Here, the railing 50 prevents a propelling device 82 from sliding down the side 43 of a post 41 thereby restricting the propelling device 82 to a desired distance from the top surface 44 of the post 41. Specifically, the top surface 44 of the post 41 can be higher or above the top of the railing 50. For example, the distance between the top surface 44 of the post 41 and the top of the railing 50 is at least substantially similar to the diameter of the rod 84 of the propelling device 82. The railing 50 can be a rod or tube with varying cross-sectional shapes and dimensions, for example, a circle, square, or the like, and with varying lengths.

Figure 3A:
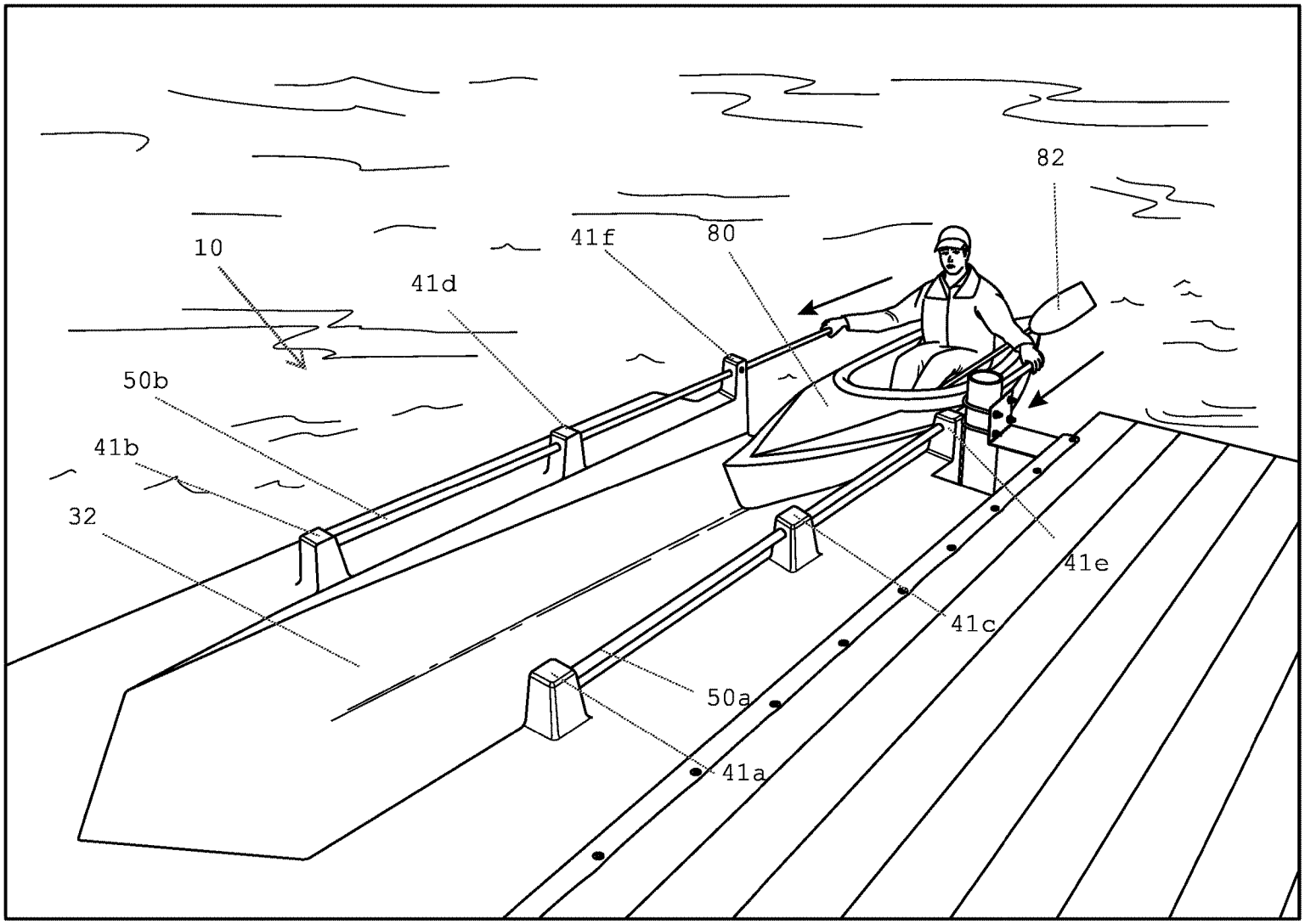
FIG. 3*a* is a perspective view of a watercraft float according to an exemplary embodiment.
Figure 3B:
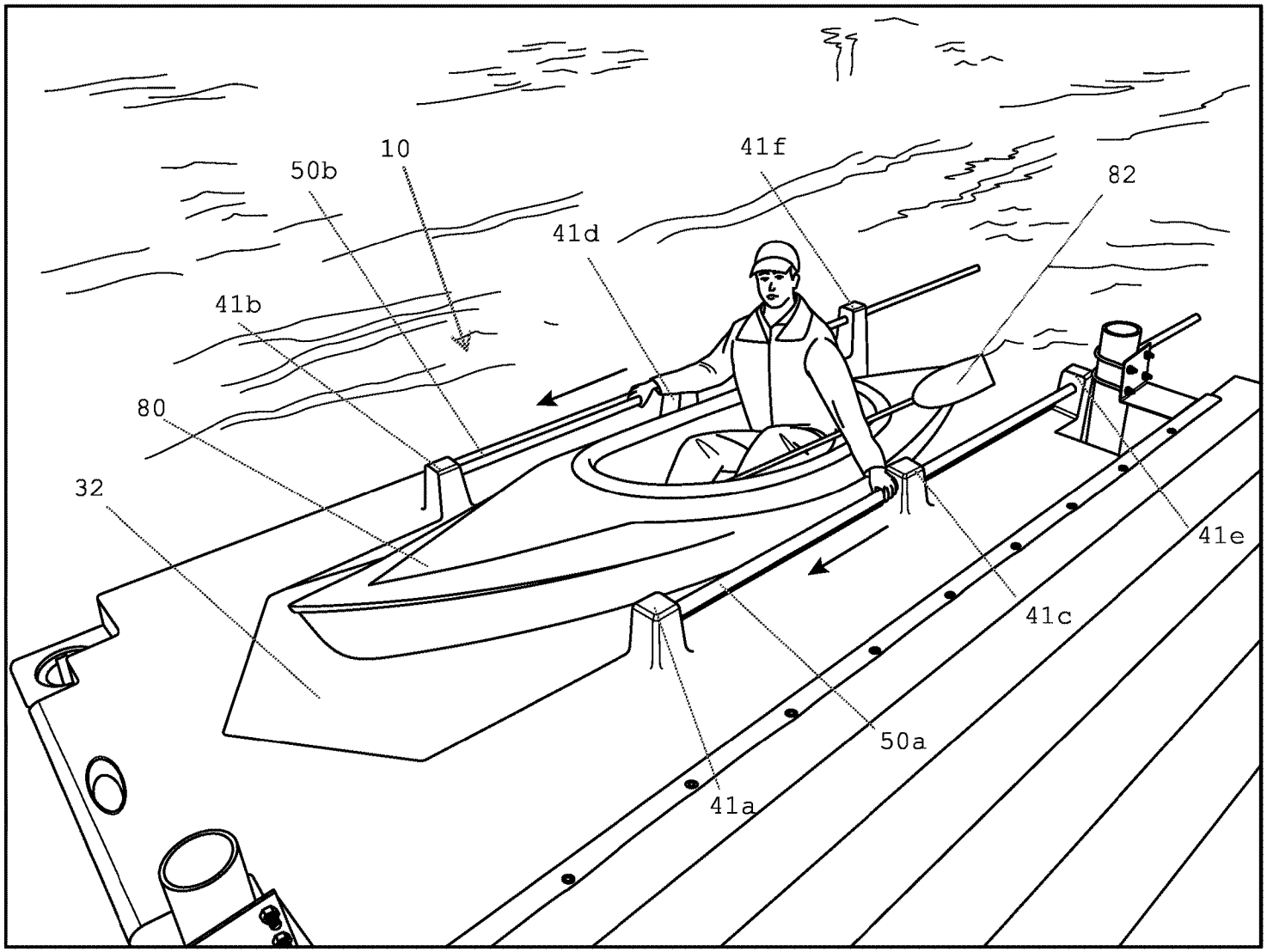
FIG. 3*b* is a perspective view of a watercraft float according to an exemplary embodiment.

As shown in FIGS. 3*a*-3*c*, and 4*a*-4*b*, the railing 50 allows for a user to propel the watercraft 80 onto the watercraft float 10, onto the receiving surface 32, into the watercraft receiving area 30, off of the watercraft float 10, off of the receiving surface 32, out of the watercraft receiving area 30, and/or the like. In one embodiment, as shown in FIG. 3*a*-3*b*, where the user desires to propel the watercraft 80 onto the receiving surface 32, the user can grip a first railing 50*a* and a second railing 50*b* and exert a pulling force onto the railings 50*a,b* thereby propelling the watercraft 80 from the water toward the front 23 of the watercraft float 10 and/or onto the receiving surface 32 of the watercraft float 10. In the same manner, the user can exert a pulling force on different portions of the railings 50*a,b* until the watercraft 80 is propelled to the desired location on the receiving surface 32.

Figure 3C:
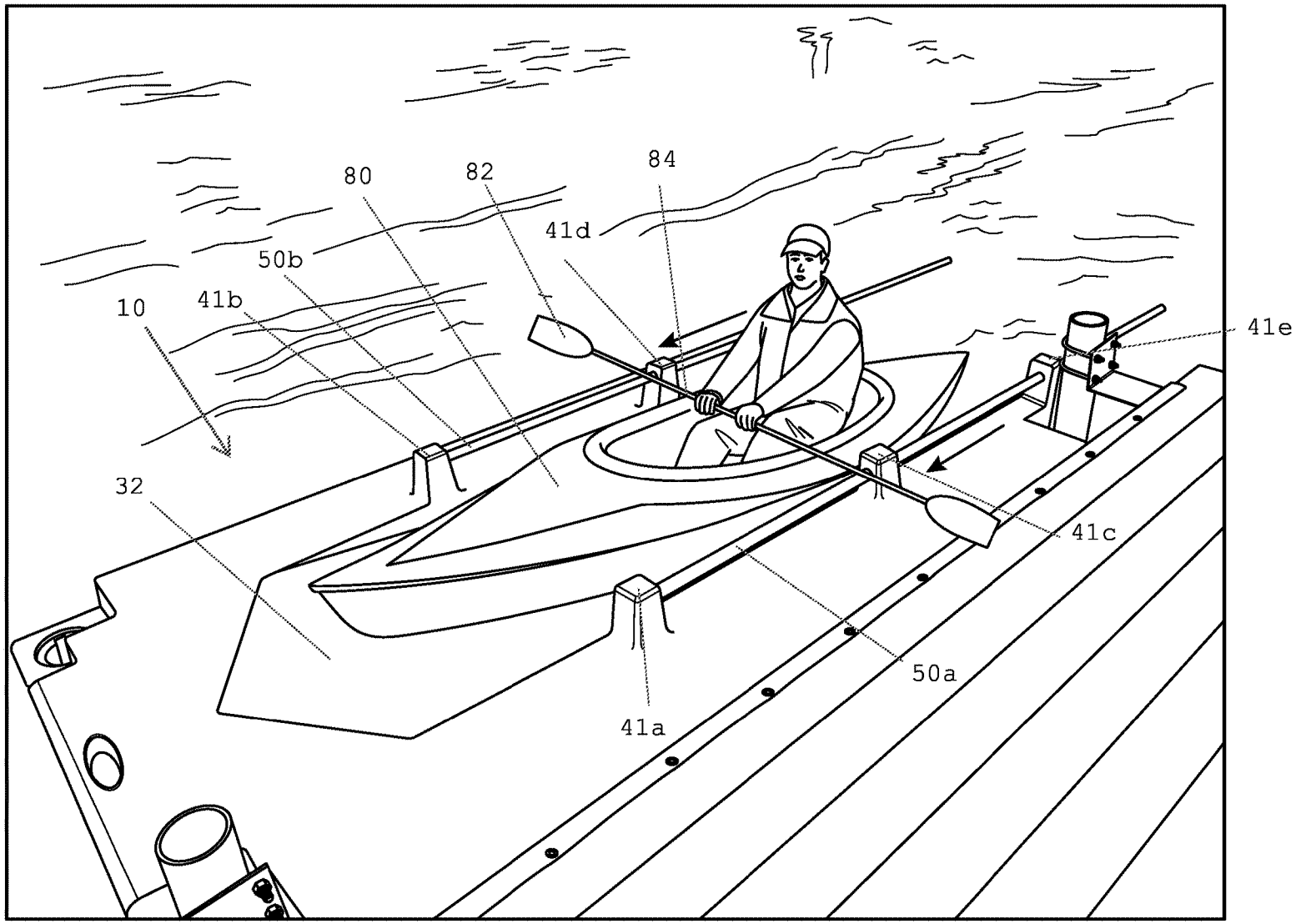
FIG. 3*c* is a perspective view of a watercraft float according to an exemplary embodiment.

In one embodiment, as shown in FIG. 3*c*, where the user desires to propel the watercraft 80 onto the receiving surface 32, the user can position a propelling device 82 or portion thereof, for example, the rod 84 of the propelling device 82, on the top of the railing 50*a* and touching a side portion 43 of a first post 41*c* and on top of a railing 50*b* and touching a side portion 43 of a second post 41*d* and exert a pulling force onto the railing 50*a,b* and post 41*c,d* thereby propelling the watercraft 80 from the receiving surface 32 of the watercraft float 10 toward the front 23. In the same manner, the user can exert a pulling force on subsequent portions of the railing 50*a,b* and posts 41 until the watercraft 80 is propelled onto the water.

Figure 4A:
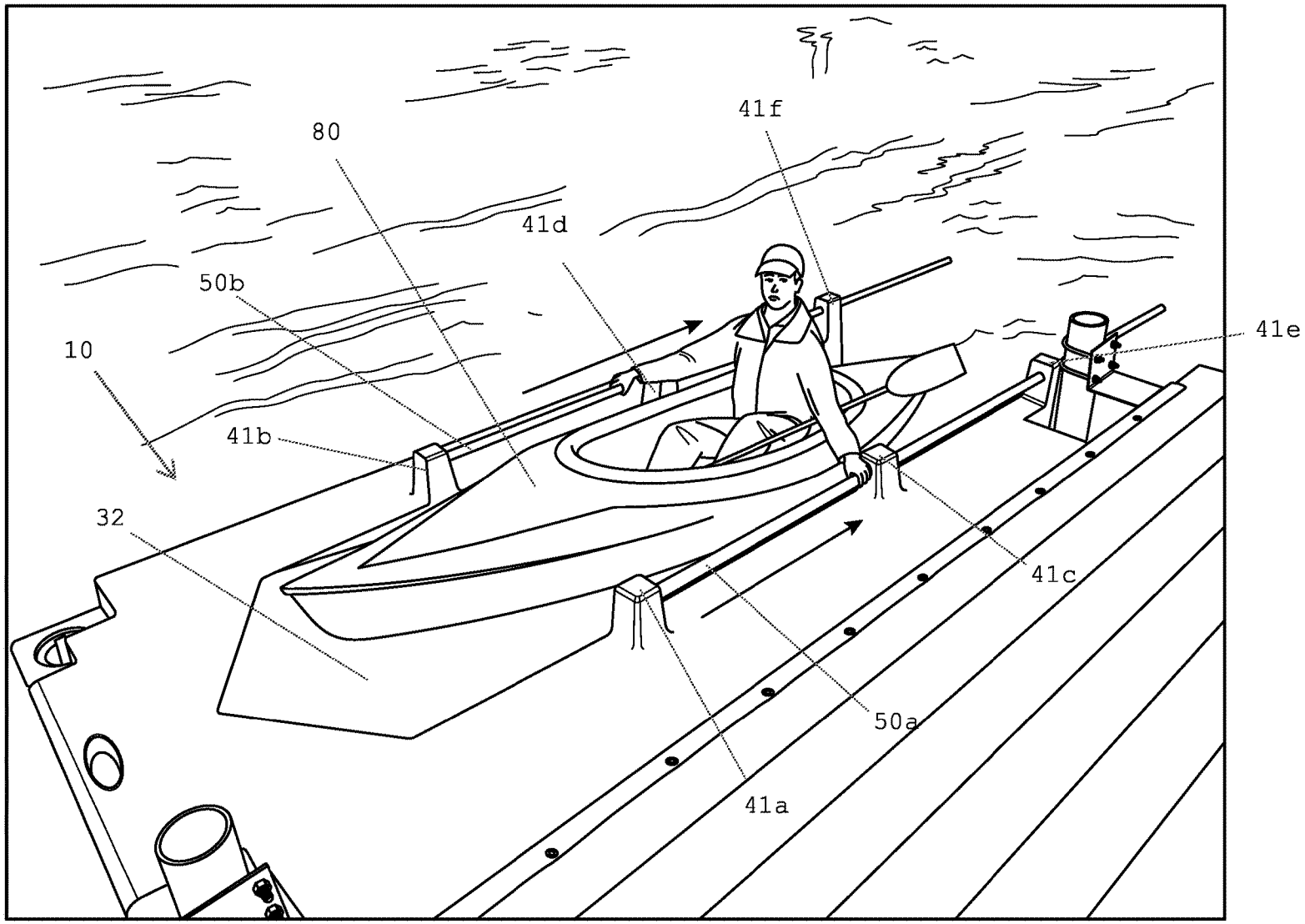
FIG. 4*a* is a perspective view of a watercraft float according to an exemplary embodiment.

FIG. 4*a*, where the user desires to propel the watercraft 80 off of the receiving surface 32, the user can grip a first railing 50*a* and a second railing 50*b* and exert a pushing force onto the railings 50*a,b* thereby propelling the watercraft 80 from the water toward the rear 24 of the watercraft float 10 and/or off of the receiving surface 32 of the watercraft float 10. In the same manner, the user can exert a pushing force on different portions of the railings 50*a,b* until the watercraft 80 is propelled to the desired location off of the receiving surface 32.

Figure 4B:
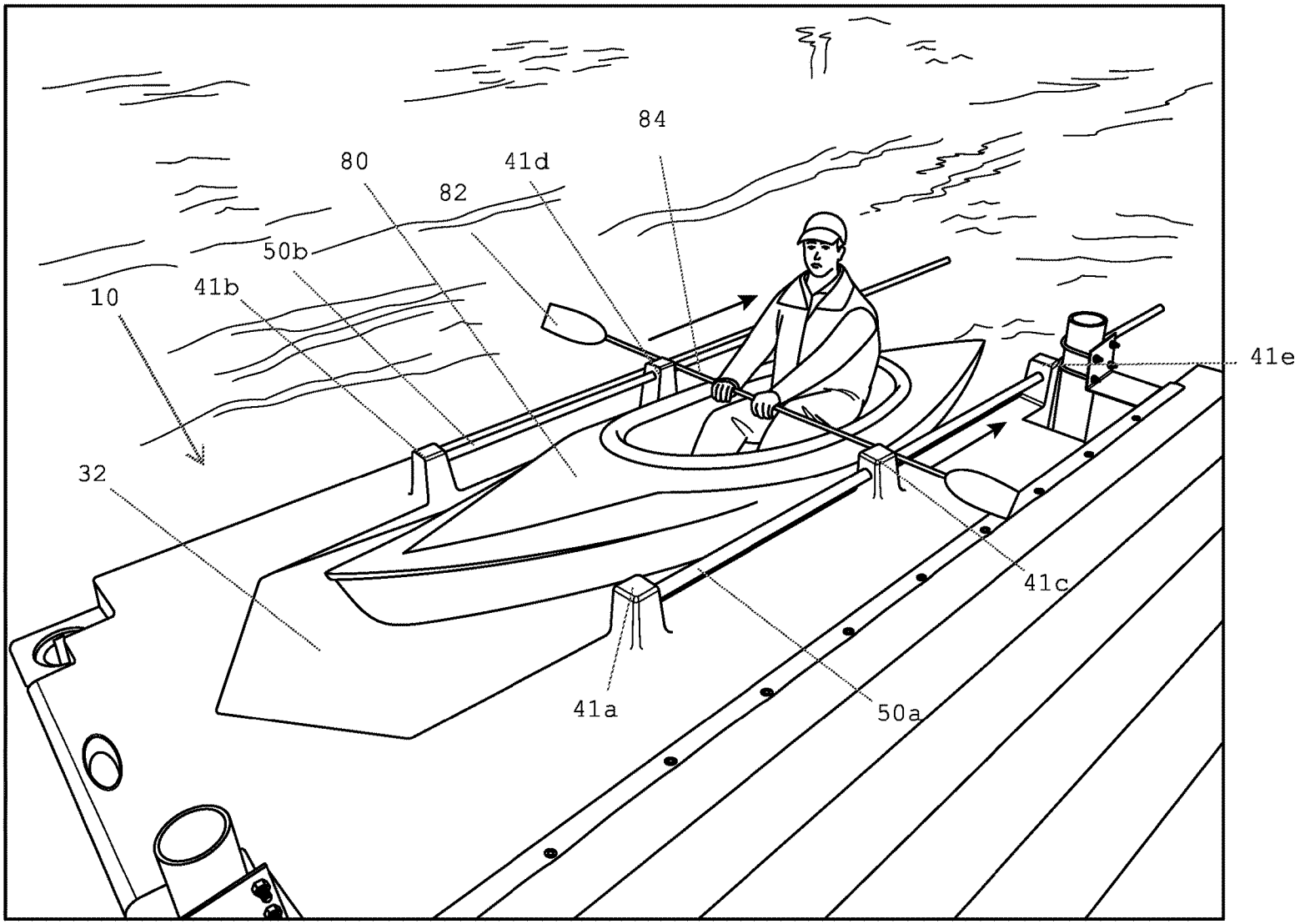
FIG. 4*b* is a perspective view of a watercraft float according to an exemplary embodiment.

In one embodiment, as shown in FIG. 4*b*, where the user desires to propel the watercraft 80 off of the receiving surface 32, the user can position a propelling device 82 or portion thereof, for example, the rod 84 of the propelling device 82, on the top of the railing 50*a* and touching a side portion 43 of a first post 41*a* and on top of a railing 50*b* and touching a side portion 43 of a second post 41*b* and exert a pushing force onto the railing 50*a,b* and post 41*c,d* thereby propelling the watercraft 80 from the receiving surface 32 of the watercraft float 10 toward the rear 24. In the same manner, the user can exert a pushing force on subsequent portions of the railing 50*a,b* and posts 41 until the watercraft 80 is propelled onto the water.

Figure 6:
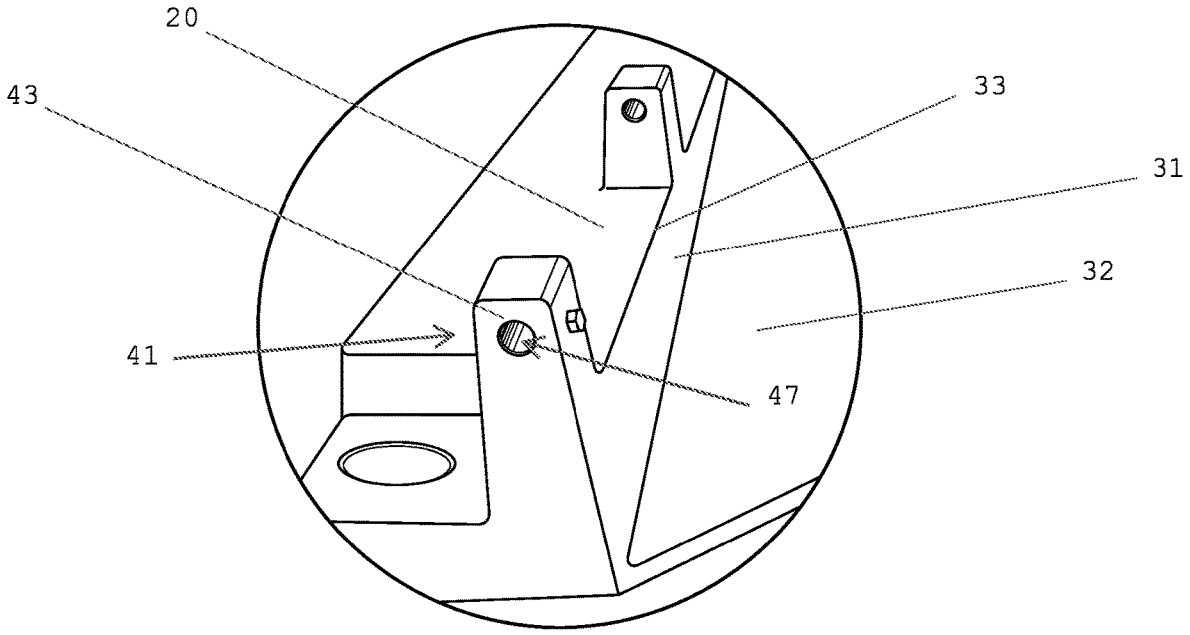
FIG. 6 is a perspective view of a portion of watercraft float according to an exemplary embodiment.

In one embodiment, the post 41 can have a hole 47 for receiving a railing 50. As shown in FIG. 6, the hole 47 can be a passageway thereby allowing for the railing 50 to pass through the width of the post 41. The hole 47 can be a cavity thereby preventing the railing 50 from passing through the entire post 41. The hole 47 can be positioned on the side portion 43 of the post 41. In one embodiment, each of a plurality of posts 41 can have a hole 47 and each hole 47 is positioned at the same location on the side portion 43 of the post 41. In one embodiment, a first hole 47 on a post 41 can be a passageway and a second hole 47 on another post 41 can be a cavity.

Figure 7:
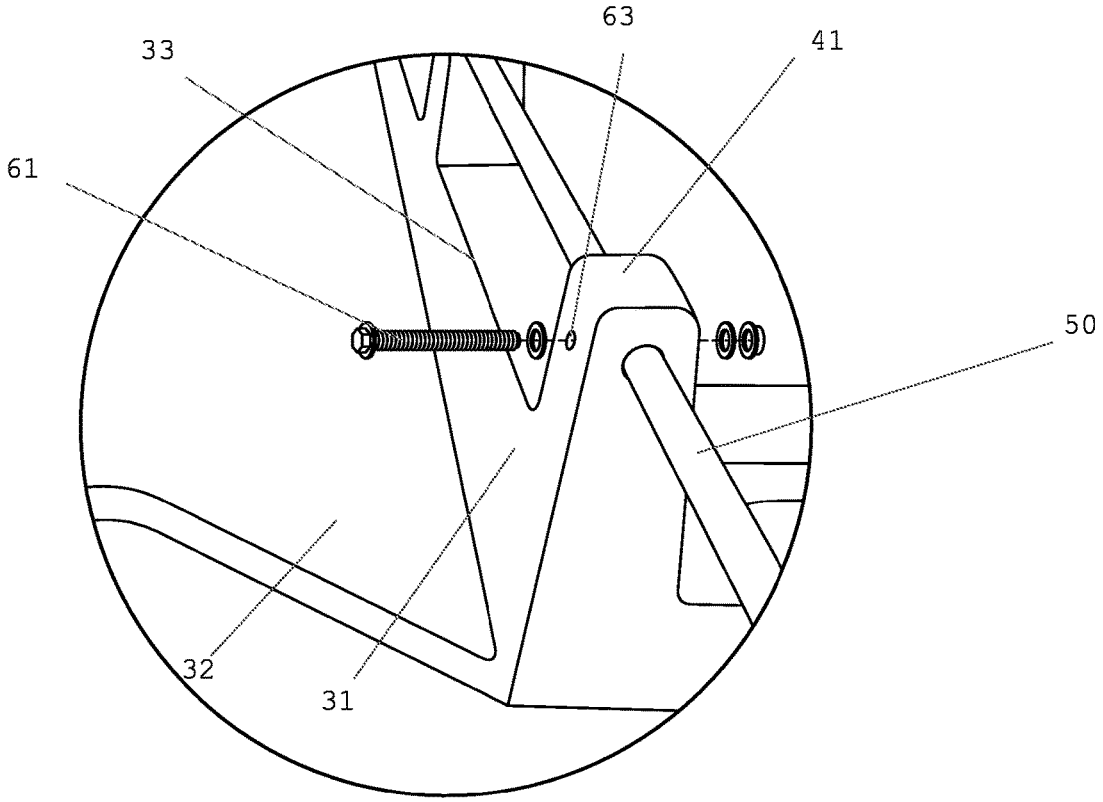
FIG. 7 is a perspective view of a securing mechanism according to an exemplary embodiment.

In one embodiment, as shown in FIG. 7, the propelling system 40 can have a securing mechanism 60 configured to secure a railing 50 to at least one post 41. While the securing mechanism 60 can be mechanism for securing a railing to a post, the securing mechanism 60 preferably has securing rod 61, for example, without limitation, a bolt, screw, or the like, a railing hole 62, and a post hole 63. The railing hole 62 can be a hole, a cavity penetrating a portion of the railing, or a passageway penetrating the entire diameter of railing. The post hole 63 can be a hole, a cavity penetrating a portion of the railing, or a passageway penetrating the entire diameter of railing. The railing hole 62 can be aligned with the post hole 63 thereby allowing for a securing rod 61 to be received by the railing hole 62 and post hole 63 and thus securing the railing 50 to the post 41.

Figure 8:
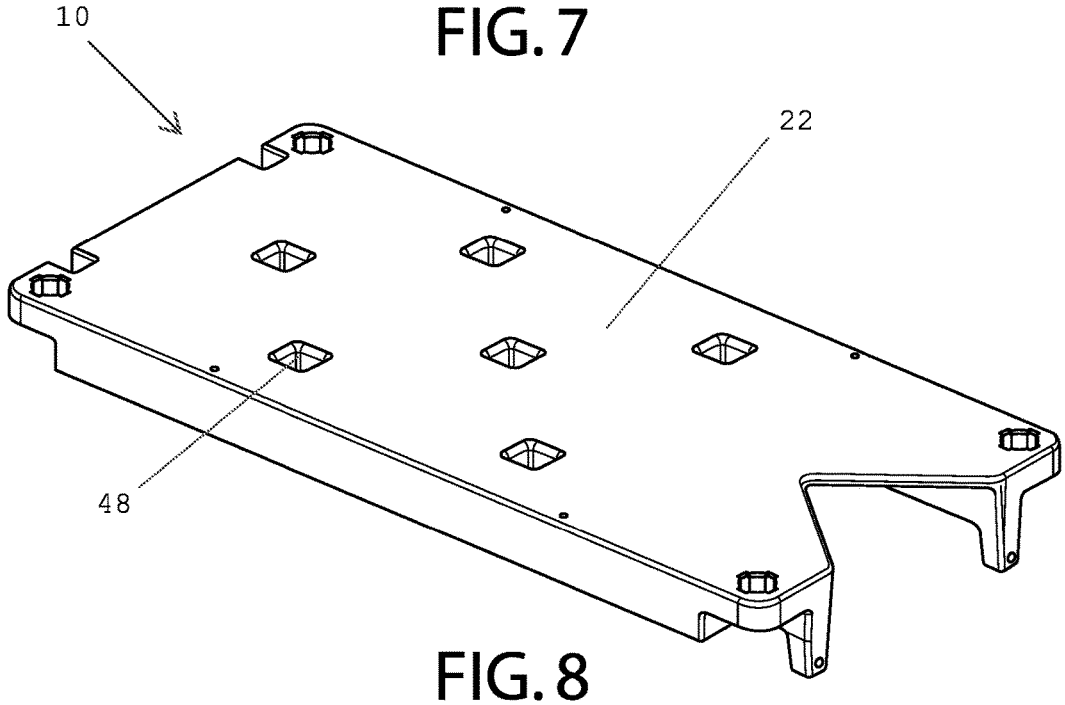
FIG. 8 is a perspective view of a watercraft float according to an exemplary embodiment.
Figure 9:
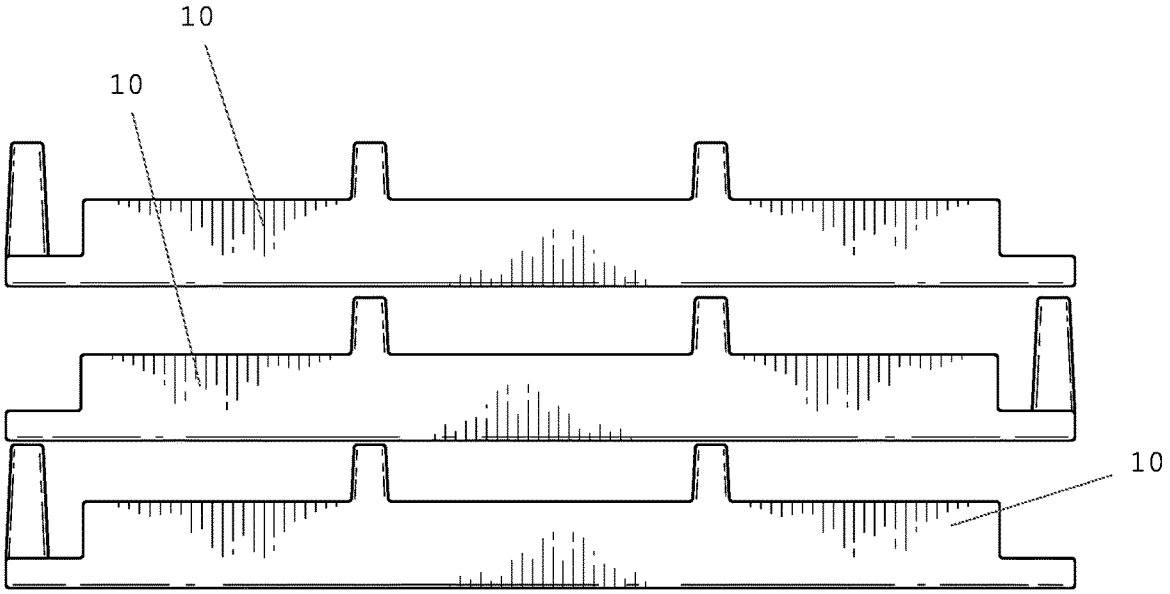
FIG. 9 is an exploded side view of a plurality of watercraft floats according to an exemplary embodiment.
Figure 10:
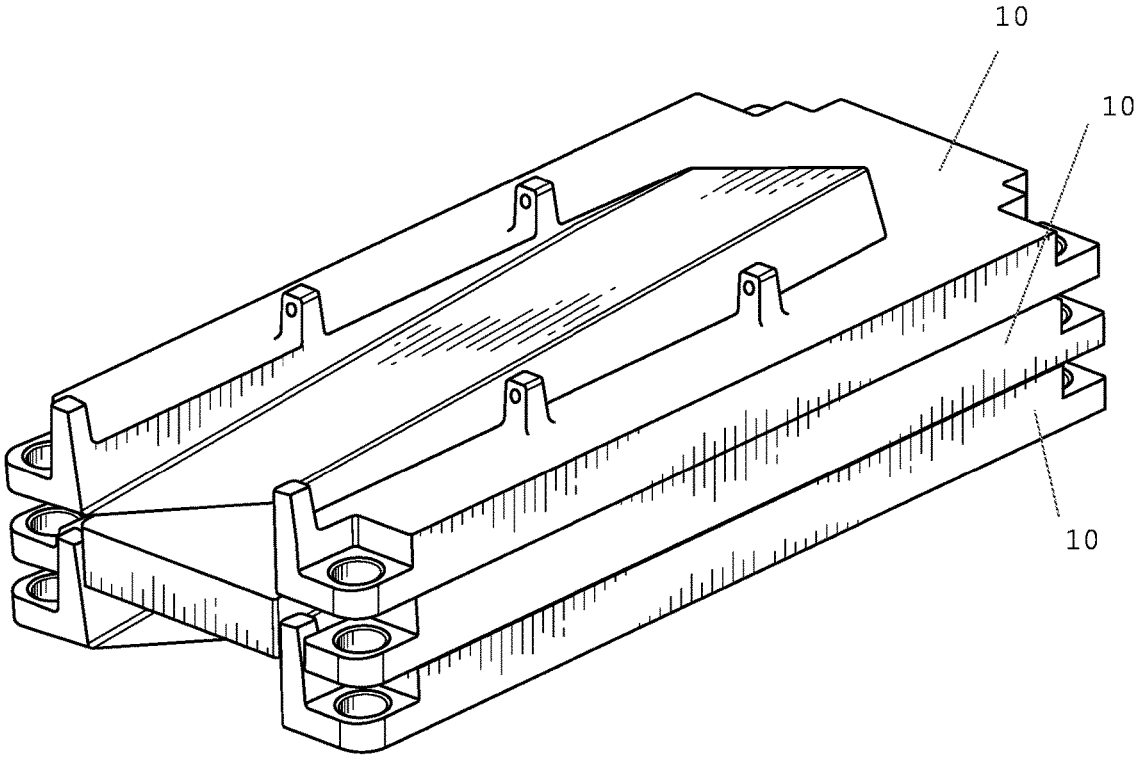
FIG. 10 is a perspective view of a plurality of watercraft floats according to an exemplary embodiment.
Figure 11:
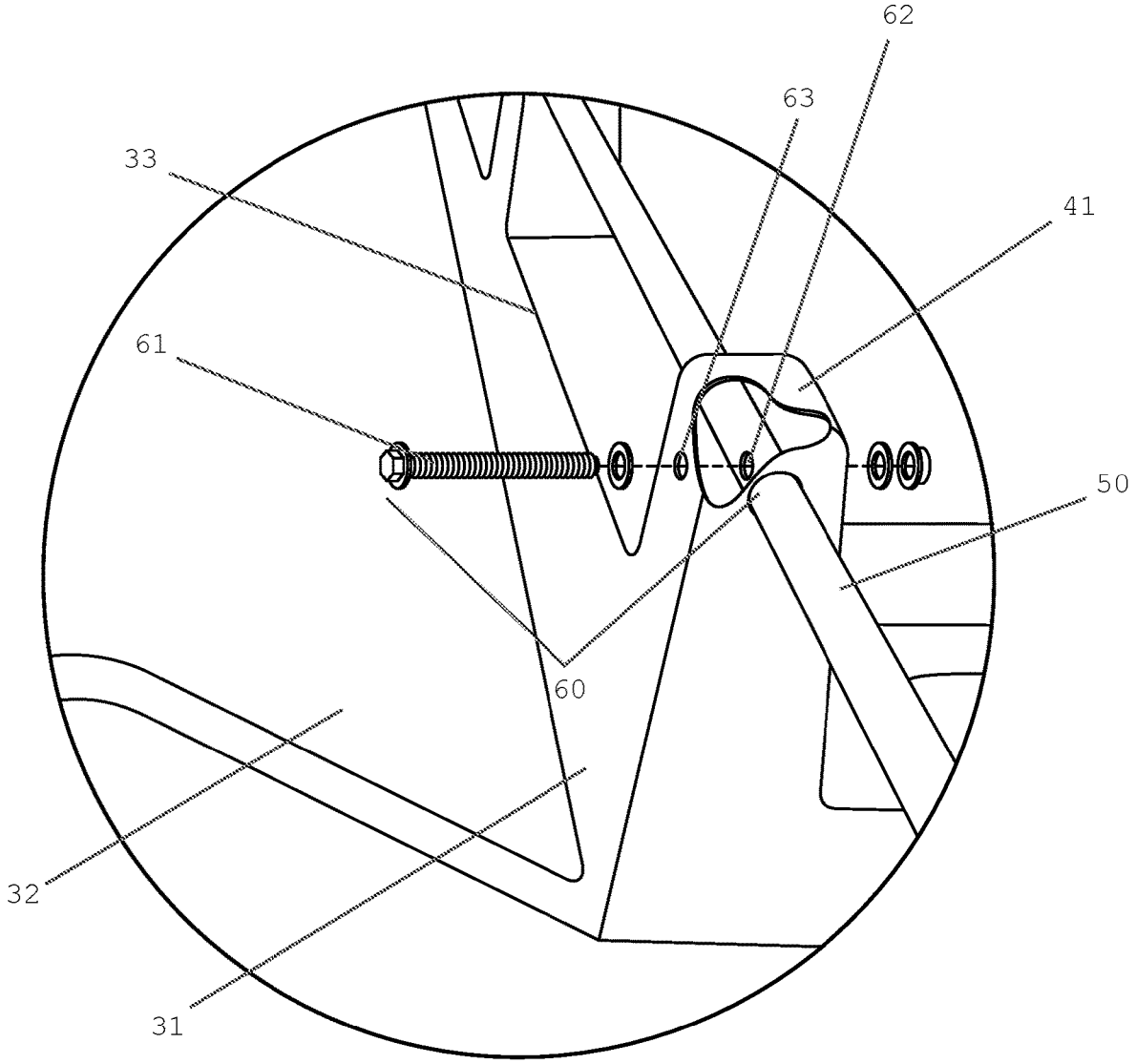
FIG. 11 is a perspective view of a securing mechanism according to an exemplary embodiment.

In one embodiment, the propelling system 40 is modular thereby allowing for a plurality of watercraft floats 10 to be stacked for storage and/or transportation purposes. In one embodiment, where the propelling system 40 is modular, the railing 50 is configured to be disengaged or released from the line of posts 46. In one embodiment, where the propelling system 40 is modular, as shown in FIGS. 8 & 9, the watercraft float 10 has at least one post cavity 48 within the bottom surface 22 substantially corresponding in location and size to the at least one post 41 protruding from the deck surface 20. Specifically, the post cavity 48 is positioned within the bottom surface 22 of the watercraft float 10 substantially below a post 41 on the deck surface 20. As shown in FIG. 10, the post cavity 48 of one watercraft float 10 is configured to receive and mate with a post 41 protruding from the deck surface 20 of another similar watercraft float 10 where the two watercraft floats 10 are positioned in a stacked array in a manner that allows for the bottom surface 22 of the upper watercraft float 10 to be in substantially close proximity with or contacting the deck surface 20 of the lower watercraft float 10. In this way, a plurality of watercraft floats 10 can be stacked together for transportation and/or storage purposes with the posts 41 and corresponding post cavities 48 interlocking to secure the stacked array.

In one embodiment, as shown in FIG. 5, the watercraft float 10 can have a mooring system 70 for securing the watercraft float 10 to a dock. The mooring system 70 can have a mooring post 71 and mooring mechanism 72. The mooring post 71 can engage the watercraft float 10 by a mooring hole 74 receiving the mooring post 71. The mooring mechanism 72 can be any mechanism for securing a post to a dock, for example, without limitation, a bracket 75 and at least one U-clamp 76, where the bracket 75 engages the dock and the U-clamp 76 receives the mooring post 71.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

Modifications and variations of the present invention are possible in light of the above teachings. It is therefore to be understood that the invention may be practiced otherwise than as specifically described herein.

What is claimed is:

1. A watercraft float comprising:

a deck surface and bottom surface, a watercraft receiving area, a first molded post having a base, side, top, and first hole, wherein the first molded post is positioned on a first side of the watercraft receiving area, wherein the first hole passes through a width of the first molded post, and wherein the first hole is configured to receive a rail, and a second molded post having a base, side, top, and second hole, wherein the second molded post is positioned on the first side of the watercraft receiving area and wherein the second hole is configured to receive the rail, wherein the first molded post the second molded post are molded into the deck surface, wherein the first molded post and the second molded post are configured so that a user can propel a watercraft onto the watercraft float, and wherein the watercraft receiving area is configured to receive the watercraft.

2. The float of claim 1 further comprising a receiving area rim, wherein the first molded post and the second molded posts engages the receiving area rim.

3. The float of claim 1 wherein the float comprises a third molded post having a third hole and a fourth molded post having a fourth hole, wherein the third hole passes through a width of the third molded post, wherein the third hole is configured to receive a second rail, wherein the fourth hold is configured to receive a second rail, wherein the third molded post and fourth molded post are positioned in a line on a second side of the watercraft receiving area and wherein the third molded post and the fourth molded post are molded into the deck surface.

4. The float of claim 1 wherein the rail is used to propel the watercraft onto or off or the watercraft float by the user gripping the rail.

5. The float of claim 1 wherein the engagement of the rail with the first molded post defines a propelling notch configured to receive a propelling device, wherein the top of the first molded post extends beyond the top surface of the rail.

6. The float of claim 5 wherein upon the propelling notch receiving the propelling device, the engagement of the rail with the first molded post is configured to prevent the propelling device from sliding down the side of the first molded post or sliding over the top of the first molded post.

7. The float of claim 1 further comprising a securing mechanism configured to releaseably secure the rail to the first molded post.

8. The float of claim 7 wherein the securing mechanism comprises:

a securing hole configured within the post, and a securing rod, wherein upon the first hole in the first molded post receiving the rail, a rail hole configured within the rail and the securing hole are aligned so that both the rail hole and the securing hole receive the securing rod.

9. The float of claim 1 wherein the watercraft float is configured to be stacked with a second watercraft float.

10. The float of claim 9 further comprising a post cavity located at a position within the bottom surface of the watercraft float so that the post cavity is configured to receive a post of the second watercraft float upon the two watercraft floats positioned in a stacked array.

11. The float of claim 1 further comprising a mooring system for securing the watercraft float to a dock.

12. The float of claim 11 wherein the watercraft float further comprises a mooring hole and the mooring system comprises a mooring post and mooring mechanism, wherein the mooring hole is configured to receive the mooring post, and wherein the mooring mechanism is configured to secure the mooring post to the dock.

* * * * *